US008103207B2

(12) United States Patent
Karasawa et al.

(10) Patent No.: US 8,103,207 B2
(45) Date of Patent: Jan. 24, 2012

(54) LUBRICANT APPLICATION APPARATUS, PROCESS CARTRIDGE, AND IMAGE FORMING APPARATUS USING SAME

(75) Inventors: Shinya Karasawa, Kawasaki (JP); Tokuya Ojimi, Kawasaki (JP); Takatsugu Fujishiro, Tokyo (JP); Hiromichi Ninomiya, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 627 days.

(21) Appl. No.: 12/265,844

(22) Filed: Nov. 6, 2008

(65) Prior Publication Data

US 2009/0120356 A1 May 14, 2009

(30) Foreign Application Priority Data

Nov. 9, 2007 (JP) ..... 2007-291573

(51) Int. Cl.
*G03G 21/00* (2006.01)

(52) U.S. Cl. ..... 399/346

(58) Field of Classification Search ..... 399/111, 399/346, 350

See application file for complete search history.

(56) References Cited

U.S. PATENT DOCUMENTS

| | | | | |
|---|---|---|---|---|
| 7,313,347 | B2 | 12/2007 | Shintani et al. | |
| 7,826,786 | B2 * | 11/2010 | Suda et al. | 399/346 |
| 7,899,382 | B2 * | 3/2011 | Hozumi et al. | 399/346 |
| 7,899,383 | B2 * | 3/2011 | Shintani et al. | 399/346 |
| 2006/0115286 | A1 | 6/2006 | Uchitani et al. | |
| 2006/0133834 | A1 | 6/2006 | Yoneda et al. | |
| 2007/0059067 | A1 | 3/2007 | Tanaka et al. | |
| 2007/0183824 | A1 | 8/2007 | Suda et al. | |
| 2008/0013998 | A1 | 1/2008 | Kumagai et al. | |
| 2008/0118285 | A1 | 5/2008 | Karasawa | |

FOREIGN PATENT DOCUMENTS

| | | | |
|---|---|---|---|
| EP | 1 521 138 | A3 | 4/2005 |
| EP | 1 744 227 | B1 | 1/2007 |
| JP | 11-327317 | | 11/1999 |
| JP | 2000-330443 | | 11/2000 |
| JP | 2001-305907 | | 11/2001 |
| JP | 2003-058011 | A | 2/2003 |
| JP | 2004-037583 | | 2/2004 |
| JP | 2004 046073 | A | 2/2004 |
| JP | 2005-121760 | | 5/2005 |
| JP | 2005-308831 | | 11/2005 |
| JP | 2005-321533 | | 11/2005 |
| JP | 2006-030438 | | 2/2006 |
| JP | 2006-047698 | A | 2/2006 |
| JP | 2006-064918 | A | 3/2006 |
| JP | 2006-154747 | | 6/2006 |
| JP | 2006-251751 | | 9/2006 |

* cited by examiner

*Primary Examiner* — William J Royer
(74) *Attorney, Agent, or Firm* — Oblon, Spivak, McClelland, Maier & Neustadt, L.L.P.

(57) ABSTRACT

A lubricant application apparatus including a lubricant application member and an elastic member. The lubricant application member applies lubricant to a lubricant receiving member moving in a given surface movement direction. The elastic member contacts the lubricant receiving member in a counter direction with respect to the surface movement direction of the lubricant receiving member, and smoothes the lubricant applied on the lubricant receiving member. The elastic member is in contact with the lubricant receiving member at a contact area of the elastic member, in the counter direction. The elastic member is positioned in a downstream side of the surface movement direction of the lubricant receiving member with respect to the contact area of the elastic member. The elastic member is in contact with the lubricant receiving member at the contact area with a contact angle of 85 degrees or more.

19 Claims, 5 Drawing Sheets

LUBRICANT APPLICATION APPARATUS, PROCESS CARTRIDGE, AND IMAGE FORMING APPARATUS USING SAME

CROSS-REFERENCE TO RELATED APPLICATIONS

This patent document claims priority under 35 U.S.C. §119 (a) to Japanese Patent Application No. 2007-291573, filed on Nov. 9, 2007 in the Japanese Patent Office, the entire contents of which are hereby incorporated by reference herein.

BACKGROUND OF THE INVENTION

1. Field of the Invention

The present disclosure generally relates to a lubricant application apparatus including a blade for smoothing lubricant supplied on a surface of an image carrying member, and an image forming apparatus, such as a copier, a facsimile, or a printer, and a process cartridge using such a lubricant application apparatus.

2. Discussion of the Background Art

Typically, an image forming apparatus using electrophotography includes a cleaning unit that cleans a surface of an image carrying member after transferring an image from the image carrying member to a transfer member (e.g. a sheet). For example, after an image transfer process, toner may remain on the surface of the image carrying member, and such remaining toner needs to be removed to prepare the image carrying member for another image forming process. Such a cleaning unit may typically use a cleaning blade made of an elastic member (e.g., polyurethane rubber) because such a blade may have a simple configuration and also a good level of a cleaning function for removing toner or the like.

Further, an image forming apparatus includes a lubricant supply unit, which supplies lubricant (e.g., aliphatic acid metal salt) to a surface of the image carrying member to reduce the friction coefficient between a cleaning blade and an image carrying member. If an amount of lubricant supplied to the surface of the image carrying member is not sufficient (e.g., lubricant amount is too little), such a friction coefficient may not be reduced sufficiently, and thereby some drawbacks may occur due to a high friction coefficient. For example, curling of the cleaning blade and a shorter lifetime of the image carrying member may result.

On the other hand, if an amount of lubricant supplied to the surface of the image carrying member is excessive (e.g., lubricant amount is too great), some lubricant may adhere to devices or the like disposed around an image carrying member, and thereby some drawbacks may occur due to such lubricant adhesion. For example, an abnormal image may result due to lubricant adhesion to a charging device or a development agent carrier.

Accordingly, in such an image forming apparatus including a function of supplying lubricant on to an image carrying member, a lubricant supply amount onto the image carrying member may need to be controlled to a given level.

Japanese Patent Application Publication 2000-330443 (hereinafter background art 1) and Japanese Patent Application Publication 2001-305907 (hereinafter background art 2) disclose image forming apparatuses including a cleaning blade and a lubricant supply unit including a lubricant smoothing device. In such configurations, the lubricant supply unit is positioned at a downstream side of a surface movement direction of an image carrying member with respect to a contact point of the cleaning blade and the image carrying member, and thereby the lubricant smoothing device is positioned at a downstream side of a surface movement direction of an image carrying member with respect to the cleaning blade. In such an image forming apparatus, the surface of the image carrying member is cleaned well before lubricant is supplied on to the image carrying member, and thereby lubricant supplied onto the surface of the image carrying member can be uniformly smoothed by the lubricant smoothing device. Further, such configurations can prevent a phenomenon that lubricant adheres to remaining toner, which remains on the image carrying member after a toner image transfer.

If such configurations are not employed, remaining toner may come to the lubricant smoothing device with lubricant applied onto the image carrying member, and the lubricant smoothing device may remove some lubricant with remaining toner, which is not preferable. Such an undesirable cleaning phenomenon of lubricant can be prevented if the above-described configuration is employed. Accordingly, such a configuration may be effective to control a lubricant supplying amount or consumption amount.

Background arts 1 and 2 each disclose a lubricant smoothing device of blade type, but the lubricant smoothing devices are supported in different manners. In background art 1, the lubricant smoothing blade is supported by a counter-direction configuration. Specifically, a support device supports the lubricant smoothing blade from a downstream side of the surface movement direction of the image carrying member with respect to a contact area of the lubricant smoothing blade and a surface of an image carrying member. On the other hand, in background art 2, the lubricant smoothing blade is supported by a trailing-direction configuration. Specifically, a support device supports the lubricant smoothing blade from an upstream side of the surface movement direction of the image carrying member with respect to a contact area of the lubricant smoothing blade and a surface of an image carrying member.

The lubricant smoothing blade can be contacted to the image carrying member with a higher contact pressure in the counter-direction configuration compared to the trailing-direction configuration. Accordingly, a phenomenon of lubricant passing through at a contact point of the lubricant smoothing blade can be prevented more effectively by employing the counter-direction configuration compared to the trailing-direction configuration.

However, the lubricant smoothing device contacting the image carrying member moving in a given direction (e.g., rotating) may vibrate due to a friction with the image carrying member even if the counter-direction configuration is employed.

If the lubricant smoothing blade contacts the image carrying member with a small contact area, the lubricant smoothing blade may not stably contact the contact point with the image carrying member due to such a vibration. Under such a vibrated condition, the lubricant smoothing device may not function properly, and thereby some lubricant, which comes to the contact point of the lubricant smoothing blade, may not be screened by the lubricant smoothing blade. In other words, lubricant may pass through the lubricant smoothing device without an adequate control of a lubricant amount. If such a passing occurs, an amount of lubricant supplied to the image carrying member cannot be controlled properly, and thereby a resultantly produced image may have a lower image quality.

SUMMARY OF THE INVENTION

The present disclosure relates to a lubricant application apparatus including a blade for smoothing lubricant supplied onto a surface of an image carrying member to control a lubricant amount supplied onto the surface of the image carrying member, and an image forming apparatus and a process cartridge using such a lubricant application apparatus.

In an aspect of the present disclosure, a lubricant application apparatus includes a lubricant application member and an elastic member. The lubricant application member applies lubricant to a lubricant receiving member moving in a given surface movement direction. The elastic member contacts the lubricant receiving member in a counter direction with respect to the surface movement direction of the lubricant receiving member, and smoothes the lubricant applied onto the lubricant receiving member. The elastic member is shaped as a blade. The elastic member is in contact with the lubricant receiving member at a contact area of the elastic member, in a counter direction, in which the elastic member is positioned at a downstream side of the surface movement direction of the lubricant receiving member with respect to the contact area of the elastic member. The elastic member is in contact with the lubricant receiving member at the contact area with a contact angle of 85 degrees or more. The contact angle is defined by an edge face of the elastic member and a tangent line at the contact point.

In another aspect of the present disclosure, a process cartridge detachably mountable to an image forming apparatus includes the above-described lubricant application apparatus, an image carrying member, and at least one of a development unit, a cleaning device, or a charge device. The process cartridge integrally supports the lubricant application apparatus, the image carrying member, and the at least one of the development unit, the cleaning device, or the charge device.

In another aspect of the present disclosure, an image forming apparatus includes an image carrying member, a charge device to charge the image carrying member, a cleaning device to clean materials adhered on the image carrying member, and the above-described lubricant application apparatus.

BRIEF DESCRIPTION OF THE DRAWINGS

A more complete appreciation of the invention and many of the attendant advantages thereof can be readily obtained and understood from the following detailed description with reference to the accompanying drawings, wherein.

Figure 1:
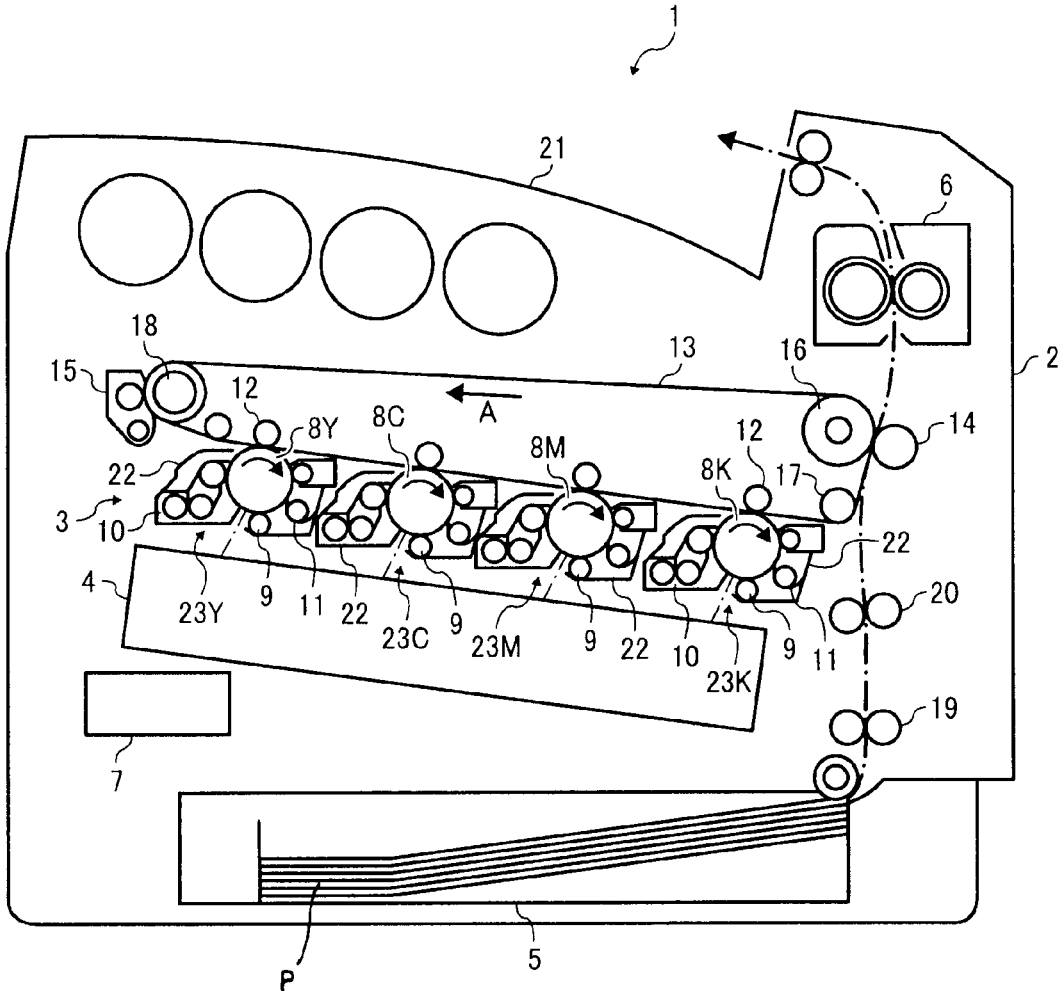
FIG. 1 illustrates a schematic configuration of an image forming apparatus according to an exemplary embodiment of the present invention.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF THE PREFERRED EMBODIMENTS

A description is now given of exemplary embodiments of the present invention. It should be noted that although such terms as first, second, and the like may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described with reference to the drawings. Such an image forming apparatus may be a color printer employing electrophotography, for example, but is not limited thereto.

FIG. 1 illustrates a schematic cross-sectional view of an image forming apparatus I according to an example embodiment. The image forming apparatus 1 includes a housing 2, an image forming engine 3, an optical writing unit 4, a sheet cassette 5, a fixing unit 6, and a waste toner recovery unit 7, for example. The optical writing unit 4 emits a laser beam to write an image on an image carrying member. The sheet cassette 5 stores a given volume of recording medium P, which is used as a transfer medium for recording an image. The fixing unit 6 fixes a toner image transferred to the recording medium P. The waste toner recovery unit 7 recovers waste toner generated after a toner image transfer process.

The image forming engine 3 forms a toner image and then transfers the toner image to the recording medium P. The image forming engine 3 includes photoconductors 8Y, 8C, 8M, 8K (which may each be identically formed, and may hereinafter be collectively referred to as "photoconductor 8"), a charge roller 9, a development unit 10, a first cleaning unit 11, primary transfer rollers 12, an intermediate transfer member 13, a secondary transfer roller 14, a second cleaning unit 15, for example. The charge roller 9, disposed around photoconductor 8, charges the photoconductor 8. The intermediate transfer member 13 carries an image (e.g., toner image) thereon transferred from the photoconductor 8. The secondary transfer roller 14 transfers the image (e.g., toner image) from the intermediate transfer member 13 to the recording medium P. In this discourse, the suffixes of Y, C, M, and K indicate respective colors of yellow, cyan, magenta, and black, and such suffixes may be omitted.

The photoconductor 8 includes a photosensitive layer as its outer layer that is used for forming an electrostatic latent image. The photoconductor 8 may have a cylindrical form, and be connected to a drive motor, by which the photoconductor 8 can be rotated in a given direction about its axis.

The charge roller 9 may be in contact with an outer surface of the photoconductor 8, or may be distanced from an outer surface of the photoconductor 8 by a small gap. The charge roller 9 is applied with voltage from a power source, by which a corona discharge occurs between the charge roller 9 and the photoconductor 8, and thereby the outer surface of the photoconductor 8 is uniformly charged.

The optical writing unit 4 emits a light beam corresponding to image data to expose the outer surface of the photoconductor 8, uniformly charged as above, to form an electrostatic latent image corresponding to the image data on the outer surface of the photoconductor 8.

The development unit 10 supplies toner to the photoconductor 8 to develop the electrostatic latent image on the outer surface of the photoconductor 8 as a toner image, in which toner is attracted on the electrostatic latent image formed on the outer surface of the photoconductor 8.

The intermediate transfer member 13 may be a loop belt, made from a resin or a rubber used as a base material. The intermediate transfer member 13 is extended by a drive roller 16 connected to a drive motor, a guide roller 17, and a tension roller 18, for example. When the drive roller 16 is rotated by the drive motor, the intermediate transfer member 13 travels in a direction shown by an arrow A in FIG. 1. The guide roller 17 and the tension roller 18 are rotated using a friction force of the intermediate transfer member 13 traveling in the direction shown by an arrow A.

The primary transfer rollers 12 are disposed at an inner surface side of the intermediate transfer member 13, and a transfer voltage is applied to the primary transfer roller 12 to transfer toner images on the photoconductor(s) 8 to the intermediate transfer member 13. Toner images formed on the photoconductor(s) 8 are sequentially transferred and superimposed on intermediate transfer member 13 to form a color toner image on the intermediate transfer member 13.

The first cleaning unit 11 cleans the outer surface of the photoconductor 8 after the toner image is transferred to the intermediate transfer member 13. With such a cleaning process, remaining toner, paper powder, or the like remaining on the outer surface of the photoconductor 8 can be recovered after a toner image is transferred to the intermediate transfer member 13. Such recovered materials are referred to as waste toner hereinafter for simplicity of expressions.

A color toner image formed on the intermediate transfer member 13 is transferred to the recording medium P at a transfer nip set between the intermediate transfer member 13 and the secondary transfer roller 14. Specifically, when the recording medium P is fed to the transfer nip, a transfer voltage is applied to the secondary transfer roller 14 to transfer the color toner from the intermediate transfer member 13 to the recording medium P. The recording medium P is transported from the sheet cassette 5 by a transport roller pair 19 and a registration roller pair 20 to the transfer nip. After transferring a toner image, the recording medium P is transported to the fixing unit 6. The fixing unit 6 applies heat and pressure to the recording medium P to melt and fix the toner image on the recording medium P. After the fixing process, the recording medium P is ejected to a sheet ejection tray 21 positioned on an outer side of the housing 2.

The second cleaning unit 15 cleans an outer surface of the intermediate transfer member 13 after transferring a color toner image to the recording medium P. With such a cleaning process, toner, paper powder, or the like remaining on the intermediate transfer member 13 after a toner image transfer can be recovered. Such toner, paper powder, or the like is referred to as waste toner.

The waste toner recovered by the first cleaning unit 11 or the second cleaning unit 15 is transported to and stored in the waste toner recovery unit 7, which may be detachably mountable to the housing 2. When the waste toner recovery unit 7 becomes full the waste toner recovery unit 7 is removed from the housing 2, and a new one is attached.

The photoconductor 8 may be integrated with other devices or the like as a process cartridge 23, such as process cartridges 23Y, 23C, 23M, and 23K as shown in FIG. 1.

For example, the photoconductor 8 and at least one of the charge roller 9, the development unit 10, or the first cleaning unit 11 may be integrally encased in a case 22 so as to configure the process cartridge 23. Accordingly, the process cartridge 23 can include the photoconductor 8 and at least one of the charge roller 9, the development unit 10, or the first cleaning unit 11. Such a configuration of the process cartridge 23 is not limited thereto, but may include a variety of devices or the like.

The process cartridge 23 may be detachably mountable to the housing 2. If the photoconductor 8, the charge roller 9, the development unit 10, and the first cleaning unit 11 are integrated as the process cartridge 23, for example, a replacement work or maintenance work of each of the devices or the like can be conducted easily by removing the process cartridge 23 from the image forming apparatus 1. Further, the photoconductor 8, the charge roller 9, the development unit 10, and the first cleaning unit 11 need to be positioned relative to one another in a precise manner. By integrating such devices or the like, such relative positioning of such devices or the like can be maintained in a higher precision, and thereby higher image quality can be maintained. A configuration of the process cartridge 23 is not limited thereto, but may include a variety of devices or the like.

In an exemplary embodiment, the photoconductor 8, the charge roller 9, the development unit 10, and the first cleaning unit 11 may be integrated as one unit. However, the process cartridge 23 may be configured in various manners. For example, the process cartridge 23 may include the photoconductor 8 and at least one of the charge roller 9, the development unit 10, or the first cleaning unit 11 as one unit using a casing or the like.

Figure 2:
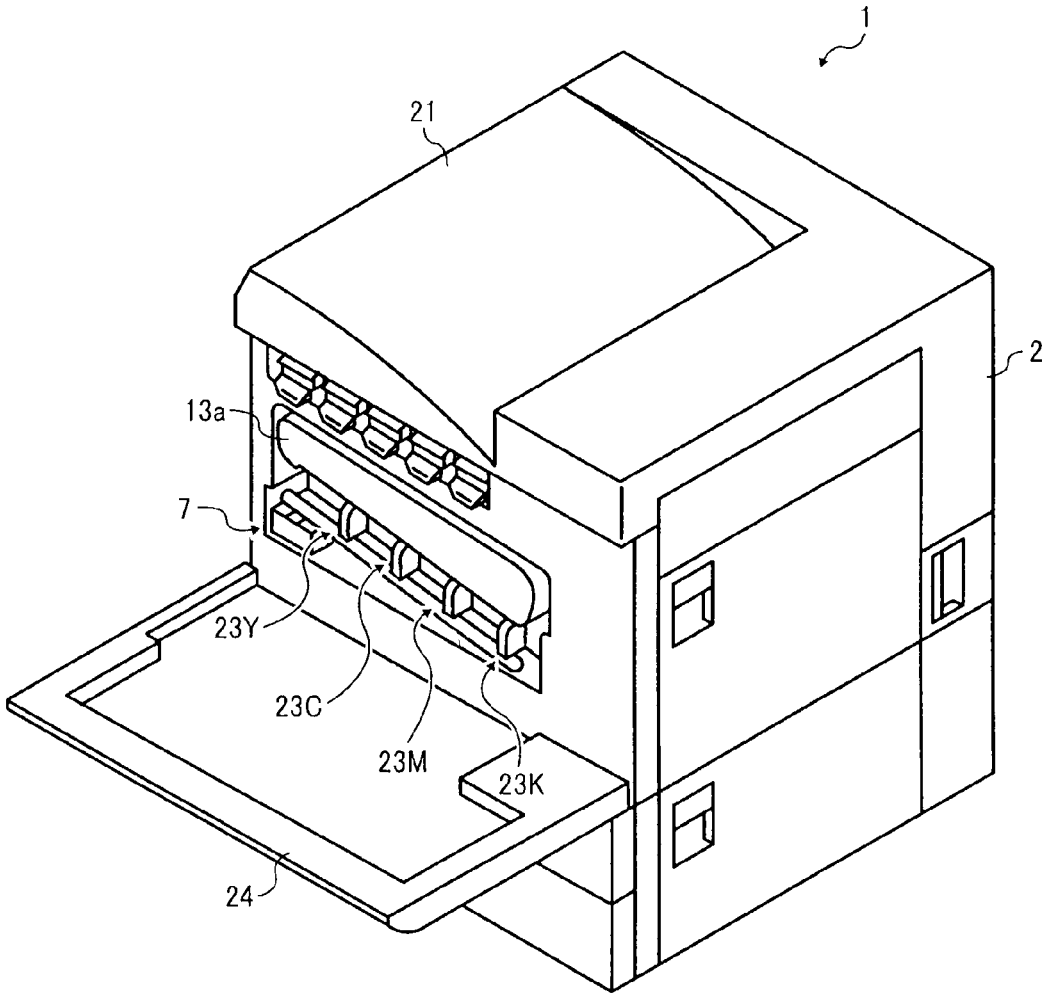
FIG. 2 illustrates a schematic perspective view of the image forming apparatus of FIG. 1, in which an outer cover is opened.

FIG. 2 illustrates a perspective view of the image forming apparatus 1, in which an outer cover 24 is opened from the housing 2. When the outer cover 24 is opened, the image forming engine 3, the waste toner recovery unit 7, or the like, are exposed, and a replacement work or a maintenance work for the process cartridge 23, the intermediate transfer member 13, the waste toner recovery unit 7, or the like can be conducted. In one example, the intermediate transfer member 13, the rollers 16, 17, 18, and the second cleaning unit 15 may be encased in a belt case 13*a* as one integrated unit.

Figure 3:
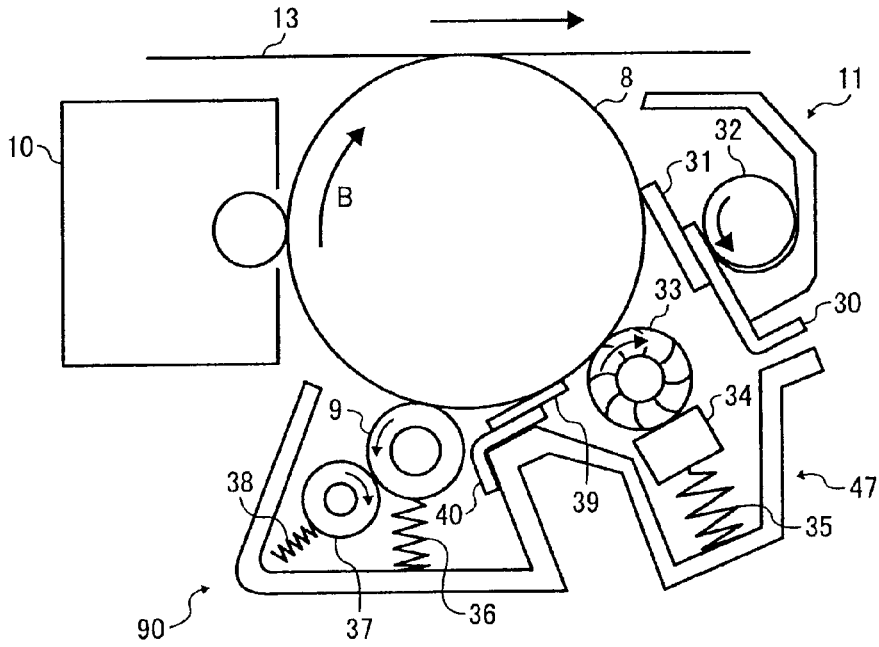
FIG. 3 illustrates a schematic cross-sectional view of a process cartridge used in the image forming apparatus of FIG. 1.

FIG. 3 illustrates an expanded view of the photoconductor 8 and its surroundings in an exemplary embodiment, in which details of the development unit 10 are omitted. The photoconductor 8 can be rotated in a direction shown by an arrow B in FIG. 3, for example.

A charge unit 90 includes the charge roller 9 made of chargeable material, and a pressure spring 36, for example. The pressure spring 36 applies a given pressure to the charge roller 9 to press the charge roller 9 toward the photoconductor 8. The charge roller 9 includes a conductive shaft and a conductive elastic layer formed on the conductive shaft. When a voltage is supplied to the conductive shaft from a power source, a given potential is generated in a gap between the conductive elastic layer of the charge roller 9 and the photoconductor 8, by which the photoconductor 8 is charged to a given potential having a given polarity. Further, the charge unit 90 includes a cleaning roller 37 held by a pressure spring 38 to remove residuals on the charge roller 9.

The development unit 10 may use two-component development agent, or one-component development agent. In the development unit 10, development agent stirred well by an agitation screw is magnetically carried on a development roller (used as a development agent carrier), and a doctor blade is used to form a thin layer of development agent on the development roller.

With a rotation of the development roller, the development agent is transported to a development-process area facing the photoconductor 8, and an electrostatic latent image on the photoconductor 8 is developed as a toner image at the development-process area.

The first cleaning unit 11 includes a cleaning blade 31 as a cleaning device and a blade holder 30 supporting the cleaning blade 31. Specifically, the blade holder 30 supports the cleaning blade 31 at a position at a downstream side of a surface movement direction of the photoconductor 8 so as to support and contact the cleaning blade 31 against the surface of the photoconductor 8 in a counter-direction configuration. For example, the cleaning blade 31 contacts the surface of the photoconductor 8 with a contact angle of 79 degrees at its contact area 31*a* and a contact pressure of 20 N/m.

In an exemplary embodiment, the cleaning blade 31 is made of urethane rubber having a JIS-A hardness of 72 degree, a thickness of 1.8 mm, a width of 326 mm, a length of 11.5 mm, a free end length of 7.6 mm, and the cleaning blade 31 contacts the surface of the photoconductor 8 with a contact angle of 90 degrees at its contact area 31*a*, for example (JIS is Japan Industrial Standard).

The first cleaning unit 11 may further include a toner recovery coil 32 to transport toner recovered by the cleaning blade 31 to a waste toner bottle.

A description is now given to a lubricant application unit 47 according to exemplary embodiments. In a first exemplary embodiment, the lubricant application unit 47 is positioned between the first cleaning unit 11 and the charge unit 90. Specifically, the lubricant application unit 47 is at a downstream side of surface movement direction of the photoconductor 8 with respect to the first cleaning unit 11, and the lubricant application unit 47 is at an upstream side of a surface movement direction of the photoconductor 8 with respect to the charge unit 90. The lubricant application unit 47 includes a brush roller 33, a lubricant block 34, and a bias spring 35, for example.

The brush roller 33 is used to supply lubricant to the photoconductor 8. The lubricant block 34 (e.g., zinc stearate block) contacts the brush roller 33. The bias spring 35 presses the lubricant block 34 against the brush roller 33.

The brush roller 33, contacting the photoconductor 8, rotates in a counter direction with respect to the photoconductor 8 as shown in FIG. 3, for example. The brush roller 33 may include a metal shaft and brush fibers implanted on the metal shaft. The brush fibers scrape lubricant from the lubricant block 34, and apply the scraped lubricant powder onto the photoconductor 8. Although zinc stearate is used as lubricant in an exemplary embodiment, other lubricants can be used.

As illustrated in FIG. 3, the lubricant application unit 47 further includes a blade 39 and a blade holder 40. The blade 39 contacts the photoconductor 8 with a given contact pressure (e.g., 20 N/m) at a downstream side of the surface movement direction of the photoconductor 8 with respect to the brush roller 33, contactable to the photoconductor 8. The blade 39 is made of a resin material such as for example polyurethane rubber.

The blade holder 40 supports the blade 39 at a position at a downstream side of the surface movement direction of the photoconductor 8 so as to support and contact the blade 39 against the surface of the photoconductor 8 in a counter-direction configuration. For example, the blade 39 contacts the surface of the photoconductor 8 at its contact area 39*a* with a contact angle of 79 degrees and a contact pressure of 20 N/m.

In the first exemplary embodiment, the blade 39 has a thickness of 1.5 mm, a width of 326 mm, a length of 10.0 mm, a free end length of 6.0 mm, and the blade 39 contacts the surface of the photoconductor 8 with a contact angle of 90 degrees at its contact area 39*a*, for example. The blade 39 may preferably have a JIS-A hardness of 73 degree or more.

With such a counter-direction configuration, the blade 39 can be in contact with the photoconductor 8 with a higher contact pressure compared to a trailing-direction configuration.

Figure 4:
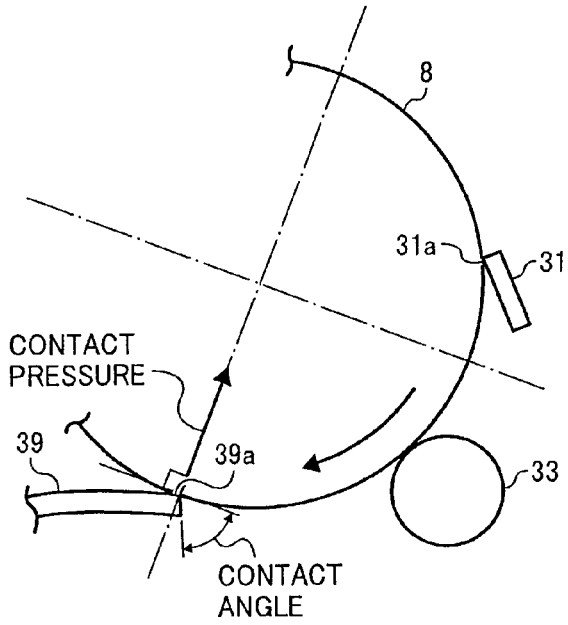
FIG. 4 illustrates a schematic configuration of a lubricant smoothing blade and a photoconductor, in which the lubricant smoothing blade contacts a surface of the photoconductor in a counter direction with a contact angle of 85 degrees.
Figure 5:
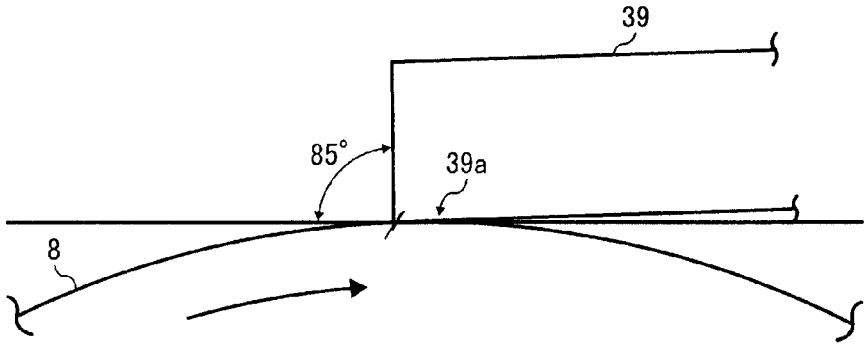
FIG. 5 illustrates an expanded view of a contact area of the lubricant smoothing blade and the photoconductor of FIG. 4.

An edge face of the blade 39 and a tangent line, extending from a contact point of the photoconductor 8, form a given contact angle. For example, the blade 39 is in contact with the photoconductor 8 to set such a contact angle as 85 degrees or more. For example, in FIG. 4 and FIG. 5, the blade 39 and the photoconductor 8 are in contact with the contact angle of 85 degrees. If the contact angle is set at 85 degrees or more, the blade 39 and the photoconductor 8 can be in contact with each other with a greater contact area (nip), by which uneven contact phenomenon due to vibration can be reduced or prevented.

Accordingly, the blade 39 can effectively screen lubricant coming to a contact point of the blade 39 and the photoconductor 8. Accordingly, a phenomenon of lubricant passing through at the contact point of the blade 39 can be prevented effectively. Such an effect will be described later with evaluation tests described later.

Further, the blade 39 can effectively trap remaining toner passing through the cleaning blade 31, and thereby an occurrence of an abnormal image due to such remaining toner can be reduced or prevented.

Figure 6:
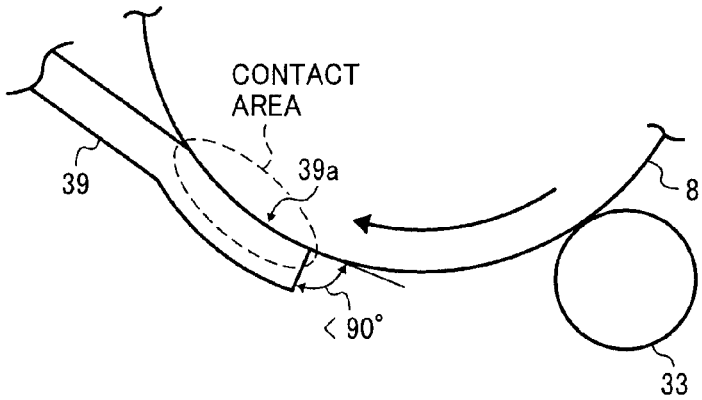
FIG. 6 illustrates a schematic configuration of a lubricant smoothing blade and a photoconductor, in which the lubricant smoothing blade contacts a surface of the photoconductor in a counter direction with a contact angle of 95 degrees.
Figure 7:
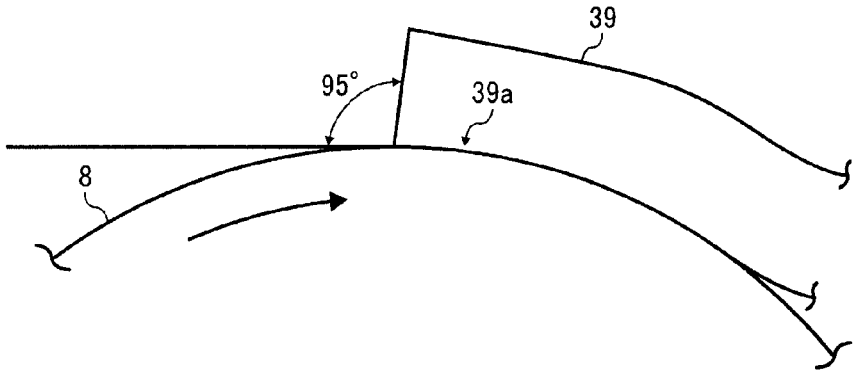
FIG. 7 illustrates an expanded view of a contact area of the lubricant smoothing blade and the photoconductor of FIG. 6.

A second exemplary embodiment for the lubricant application unit 47 has a similar configuration as the first exemplary embodiment except for a contact condition of the photoconductor 8 and the blade 39 as shown in FIG. 6. An edge face of the blade 39 and a tangent line, extending from a contact point of the photoconductor 8, form a contact angle of 90 degrees or more. For example, in FIG. 6, the blade 39 is in contact with the photoconductor 8 to set such a contact angle as 95 degrees. Under such a contact angle condition, a portion of one side face of the blade 39 is in contact along a surface of the photoconductor 8, by which the blade 39 contacts the photoconductor 8 with a greater contact area (nip) as shown in FIG. 7 compared to a contact area (nip) of the first exemplary embodiment shown in FIG. 4, and the contact configuration shown in FIG. 6 and FIG. 7 can reduce or prevent uneven contact phenomenon due to vibration.

Accordingly, the blade 39 can effectively screen lubricant coming to the contact point of the blade 39 and the photoconductor 8. Accordingly, a phenomenon of lubricant passing through at the contact point of the blade 39 can be prevented effectively. Such an effect will be described later with respect to evaluation tests described later.

Further, the blade 39 can effectively trap remaining toner passing the cleaning blade 31, and thereby an occurrence of an abnormal image due to such remaining toner can be reduced or prevented.

A description is now given of an evaluation test. The evaluation test was conducted by using an image forming apparatus "Imagio MP C4500," a product of Ricoh Company, and the lubricant application unit 47 having different conditions as set in the following Examples and Comparative Examples. In the evaluation test, the photoconductor 8 having a diameter of 40 mm was rotated with a linear velocity of 205 mm/sec, and the lubricant of zinc stearate was used.

To evaluate a performance of each of Examples and Comparative Examples, a running test was conducted to evaluate several event categories using a given number of sheets. Such event categories include "sudden pass-through," "usual pass-through," "screaming sound," "cleaning performance" and "curling." Each of the event categories was evaluated in three levels. If nothing happens, it was evaluated as "O," which means the performance was good enough. If the event constantly happens, it is evaluated as "X," which means the performance was not good. If the event occasionally happens, it is evaluated as "Δ," which means the performance was fair.

Evaluation of "Sudden Pass-Through"

Two A4-size sheets were fed for an image forming process as one set, and a total of 80,000 sheets were fed for image forming processes while feeding two A4-size sheets with a given interval. After the 80,000 sheets of image forming processes, a contamination amount of the charge roller 9 was evaluated. In the test, the charge roller 9 was disposed at a downstream side in a surface moving direction of the photoconductor 8 with respect to the lubricant application unit 47.

Evaluation of "Usual Pass-Through"

The cleaning roller 37 for cleaning the charge roller 9 was removed from the lubricant application unit 47, and 200 sheets were fed for continuous image forming. After the 200 sheets of image forming process, a contamination amount of the charge roller 9 was evaluated.

Evaluation of "Curling"

During a sudden pass-through evaluation, a testing person checked whether a curling had occurred to the contact area 39*a* of the blade 39 by a visual inspection.

Evaluation of "Screaming Sound"

During the running test, a testing person checked whether a screaming sound had occurred by ear.

Evaluation of "Cleaning Performance"

At a low temperature and low humidity environment, a solid toner image was formed on the photoconductor 8 wherein the toner image was not transferred to the intermediate transfer member 13. Then, the toner image on the photoconductor 8 was cleaned. After the cleaning process, an amount of toner remaining on the photoconductor 8 as measured for evaluating a cleaning performance of the lubricant application unit 47.

A description is given to configurations set for the lubricant application unit 47 used in the evaluation test for each of the Examples and Comparative Examples.

EXAMPLE 1

The configuration of the lubricant application unit 47 for Example 1 was similar to the first exemplary embodiment, and the blade 39 had a JIS-A hardness of 70 degrees, and a contact angle of 85 degrees.

EXAMPLE 2

The configuration of the lubricant application unit 47 for Example 2 was similar to the first exemplary embodiment, and the blade 39 had a JIS-A hardness of 73 degrees, and a contact angle of 85 degrees.

EXAMPLE 3

The configuration of the lubricant application unit 47 for Example 2 was similar to the second exemplary embodiment, and the blade 39 had a JIS-A hardness of 73 degrees, and a contact angle of 90 degrees.

EXAMPLE 4

The configuration of the lubricant application unit 47 for Example 2 was similar to the second exemplary embodiment, and the blade 39 had a JIS-A hardness of 73 degrees, and a contact angle of 95 degrees.

COMPARATIVE EXAMPLE 1

Figure 8:
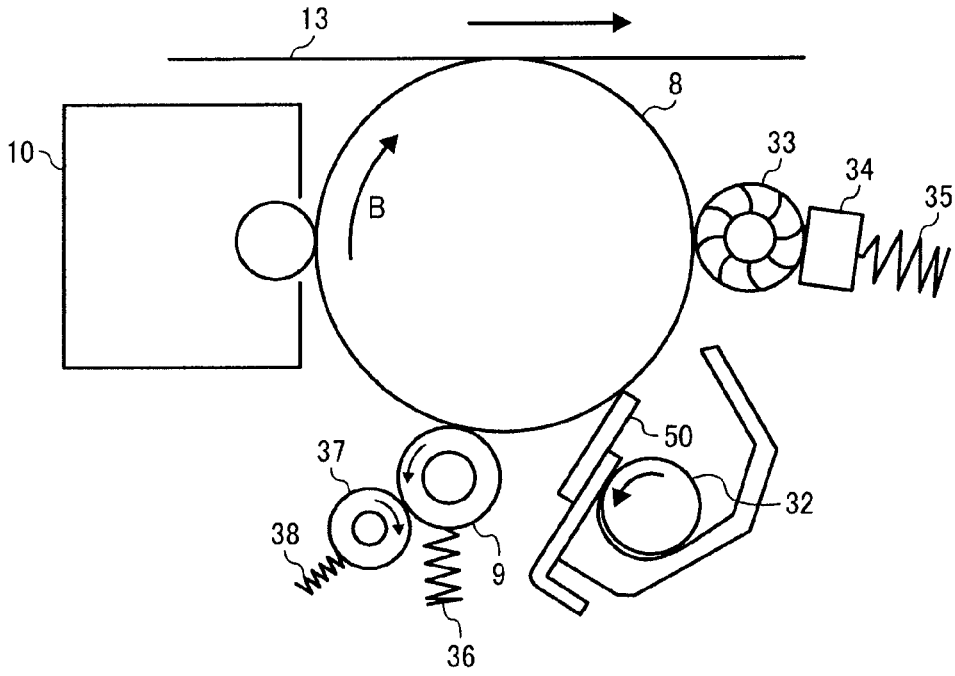
FIG. 8 illustrates a schematic configuration of a process cartridge including one blade employed for a cleaning function and a lubricant application function.

As illustrated in FIG. 8, the configuration for Comparative Example 1 includes one blade 50 for cleaning, and smoothing lubricant. The one blade 50 was made of a material of polyurethane rubber, and had a JIS-A hardness of 73 degrees. The one blade 50 contacted the photoconductor 8 at its edge portion with an angle of 82 degrees, had a thickness of 1.8 mm, a width of 326 mm, a length of 11.5 mm, and a free end length of 7.6 mm. The one blade 50 was in contact with the photoconductor 8 in a counter-direction configuration.

COMPARATIVE EXAMPLE 2

The configuration for Comparative Example 1 was used for Comparative Example 2 except the one blade 50 was in contact with the photoconductor 8 in a counter-direction configuration with a contact angle of 84 degrees.

COMPARATIVE EXAMPLE 3

Figure 9:
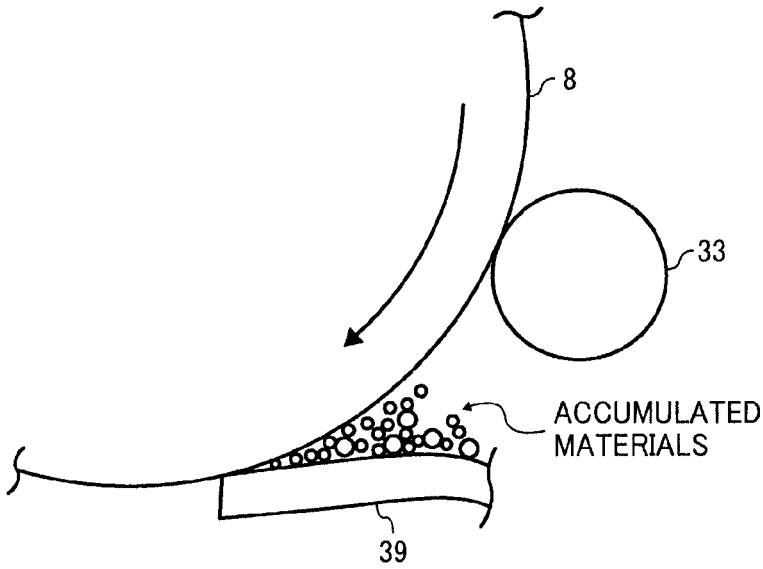
FIG. 9 illustrates a schematic configuration of a lubricant smoothing blade and a photoconductor, in which the lubricant smoothing blade contacts the photoconductor in a trailing direction.

The configuration of the lubricant application unit 47 for Comparative Example 3 was similar to the first exemplary embodiment, but the blade 39 was in contact with a trailing-direction configuration (not a counter-direction configuration) as shown in FIG. 9, and the blade 39 had a JIS-A hardness of 84 degree and a contact angle of 5 degrees.

COMPARATIVE EXAMPLE 4

The configuration of the lubricant application unit 47 for Comparative Example 4 was similar to the first exemplary embodiment, and the blade 39 had a JIS-A hardness of 73 degrees, and a contact angle of 82 degrees.

COMPARATIVE EXAMPLE 5

The configuration of the lubricant application unit 47 for Comparative Example 4 was similar to the first exemplary embodiment, and the blade 39 had a JIS-A hardness of 73 degrees, and a contact angle of 97 degrees.

Table 1 shows test results of Examples 1 to 4 and Comparative Examples 1 to 5.

which a lubricant amount on the photoconductor 8 may vary because some area on the photoconductor 8 has remaining toner and some area on the photoconductor 8 has no remaining toner, by which the one blade 50 may not uniformly smooth the lubricant, and thereby a lubricant amount on the photoconductor 8 may vary. For example, some areas on the photoconductor 8 may have too much lubricant, and some areas on the photoconductor 8 may have too little lubricant.

TABLE 1

| | | CONTACT CONDITION | | | BLADE | | | | | | |
|---|---|---|---|---|---|---|---|---|---|---|---|
| | | CONTACT DIRECTION | ANGLE [°] | CONTACT AREA | MATERIAL | JIS A HARDNESS | SUDDEN PASS-THROUGH | USUAL PASS-THROUGH | SCREAMING SOUND | CLEANING PERFORMANCE | CURLING |
| EX. 1 | TWO BLADES | COUNTER | 85 | SMALL | POLYURETHANE RUBBER | 70 | ○ | ○ | ○ | ○ | Δ |
| EX. 2 | TWO BLADES | COUNTER | 85 | SMALL | POLYURETHANE RUBBER | 73 | ○ | ○ | ○ | ○ | ○ |
| EX. 3 | TWO BLADES | COUNTER | 90 | LARGE | POLYURETHANE RUBBER | 73 | ○ | ○ | ○ | ○ | ○ |
| EX. 4 | TWO BLADES | COUNTER | 95 | LARGE | POLYURETHANE RUBBER | 73 | ○ | ○ | ○ | ○ | ○ |
| COMP. EX. 1 | ONE BLADE | — | 82 | SMALL | POLYURETHANE RUBBER | 73 | ○ | Δ | ○ | ○ | ○ |
| COMP. EX. 2 | ONE BLADE | — | 84 | SMALL | POLYURETHANE RUBBER | 73 | ○ | Δ | ○ | Δ | ○ |
| COMP. EX. 3 | TWO BLADES | TRAILING | 5 | SMALL | POLYURETHANE RUBBER | 84 | X | Δ | ○ | ○ | ○ |
| COMP. EX. 4 | TWO BLADES | COUNTER | 82 | SMALL | POLYURETHANE RUBBER | 73 | ○ | X | ○ | ○ | ○ |
| COMP. EX. 5 | TWO BLADES | COUNTER | 97 | LARGE | POLYURETHANE RUBBER | 73 | ○ | ○ | X | ○ | ○ |

Based on the result of the Examples 1 to 4 shown in Table 1, when the blade 39 contacted a surface of the photoconductor 8 in a counter direction with a contact angle of 85 degrees or more, it is estimated the passing through phenomenon of lubricant and remaining toner can be reduced. Such an effect may be attributed to the above-described greater contact area (nip) between the blade 39 and a surface of the photoconductor 8 because a greater contact area (nip) can reduce uneven contact phenomenon due to vibration. Furthermore, the results of Examples 1 to 4 indicate that a good cleaning performance and a reduction of screaming sound had been preferably obtained.

When the blade 39 for smoothing lubricant had a JIS-A hardness of 70 degrees as in Example 1, the blade 39 had a curling phenomenon on the contact area 39*a*, but when the blade 39 had a JIS-A hardness of 73 degree as in Examples 2 to 4, such a curling phenomenon was prevented.

As illustrated in FIG. 8, in Comparative Examples 1 and 2, lubricant was supplied to a surface of the photoconductor 8 at an upstream side of a surface movement direction of the photoconductor 8 with respect to the one blade 50. In such a configuration, the one blade 50 was used to uniformly smooth lubricant supplied on a surface of the photoconductor 8. Therefore, without another device for smoothing lubricant, lubricant supplied on a surface of the photoconductor 8 can be uniformly smoothed by the one blade 50.

However, in such a configuration, lubricant may enter a contact point of the one blade 50 with remaining toner, by Further, in such a configuration, lubricant may stick to remaining toner and then may be removed or cleaned with remaining toner. Accordingly, a lubricant supplying amount and consumption amount was not controlled well in Comparative Examples 1 and 2.

In Comparative Example 2, the one blade 50 and a surface of the photoconductor 8 had a greater contact area compared to Comparative Example 1, by which a contact pressure of the one blade 50 and a surface of the photoconductor 8 might become small. Accordingly, a cleaning performance became lower in Comparative Example 2.

In Comparative Example 3, the blade 39 was in contact with a surface of the photoconductor 8 in a trailing direction, by which an amount of lubricant that passed through the blade 39 might become larger, which might be an inadequate amount. As illustrated in FIG. 9, the blade 39 was positioned under the photoconductor 8 in a trailing direction and under the photoconductor 8 in a gravitation direction in Comparative Example 3. Specifically, a position of the blade 39 is set under the rotation center of photoconductor 8 in a gravitation direction. Accordingly, lubricant or toner may accumulate on the blade 39, and such accumulated materials may stick to the charge roller 9 disposed at a downstream side of a surface movement direction of the photoconductor 8, by which an abnormal image may occur.

When the blade 39 was in contact with a surface of the photoconductor 8 in a counter direction as in Examples 1 to 4, lubricant or toner tended not to accumulate on the blade 39 even when the blade 39 was positioned under the rotation center of the photoconductor 8 in a gravitation direction, by which an abnormal image due to the above-described accumulated materials can be reduced or prevented.

In Comparative Example 4, the contact angle of the blade 39 and a surface of the photoconductor 8 was 82 degrees, which was small, and a contact area (nip) of the blade 39 and the photoconductor 8 was small. Accordingly, an uneven contact phenomenon due to vibration might occur, and by which an amount of lubricant that passed through the blade 39 might become larger, which might be an inadequate amount passing through.

In Comparative Example 5, the contact angle of the blade 39 and a surface of the photoconductor 8 was 97 degrees, which was large compared to Examples 2 to Example 4, and a contact area (nip) of the blade 39 and the photoconductor 8 was large. Accordingly, uneven contact phenomenon due to vibration might be reduced, by which lubricant, remaining toner, or the like might not pass through the blade 39. Further as similar to Examples 2 to 4, a curling phenomenon was prevented or reduced and a cleaning performance was good in Comparative Example 5.

However, in Comparative Example 5, a screaming sound was observed, which was different from Examples 2 to 4. This might have been caused by the greater contact area of the blade 39 and a surface of the photoconductor 8.

Based on the above results, the blade 39 used for the lubricant application unit 47, made of a material of polyurethane rubber, having a JIS-A hardness of 73 or more, and contacting a surface of the photoconductor 8 in a counter direction of a surface movement direction of the photoconductor 8 with a contact angle of from 85 degrees to 95 degrees can maintain a good level of cleaning performance of the blade 39, can reduce passing through of lubricant or remaining toner, can reduce screaming sound, and can prevent curling. Accordingly, the blade 39 can maintain its performance at a good level over time.

In the exemplary embodiments, the lubricant application unit 47 includes the brush roller 33 for applying lubricant to a surface of the photoconductor 8, moving in a given direction, and the blade 39 contacting a surface of the photoconductor 8 in a counter direction of surface movement direction of the photoconductor 8. The blade 39 uniformly smoothes lubricant applied on a surface of the photoconductor 8.

The blade 39 contacts a surface of the photoconductor 8 at the contact area 39*a*, and an edge face of the blade 39 has an angle of 85 degrees or more with a tangent line extended from a contact portion of the contact area 39*a* and a surface of the photoconductor 8. Preferably, such angle may be 90 degrees. By setting the contact angle to 85 degrees or more, the blade 39 and a surface of the photoconductor 8 have a contact area that is large enough for reducing lubricant amount passing through the blade 39.

Accordingly, uneven contact phenomenon due to vibration at the contact point of the blade 39 and the photoconductor 8 can be reduced or prevented, and thereby passing through of lubricant at the blade 39 can be effectively reduced or prevented. Accordingly, the blade 39 can control a lubricant amount supplied on the photoconductor 8 at a preferable level.

Furthermore, in the exemplary embodiments, the contact angle defined by the tangent line and the edge face of the blade 39 can be set from 85 degrees to 95 degrees, by which a contact area of the blade 39 and a surface of the photoconductor 8 can be set great, and thereby a passing through phenomenon of lubricant or toner at the blade 39, which may happen at a given interval or sporadically, can be reduced.

Furthermore, in the exemplary embodiments, the blade 39 can be in contact with a surface of the photoconductor 8 by contacting the contacting area 39*a* along the surface of the photoconductor 8. Such a contacting configuration can enlarge a contact area of the blade 39 and the photoconductor 8 compared to contacting only an edge of the contact area 39*a* to a surface of the photoconductor 8. Accordingly, passing through phenomenon of lubricant or toner at the blade 39, which may happen at a given interval or sporadically, can be reduced.

Furthermore, in the exemplary embodiments, the blade 39 has a JIS-A hardness of 73 degrees to enhance a blade strength, by which curling at the contact area 39*a* can be reduced or prevented.

Furthermore, in the exemplary embodiments, the blade 39 is positioned under the rotation center of the photoconductor 8 in a gravitation direction in a counter direction with respect to a surface movement direction of the photoconductor 8, by which lubricant or toner may not accumulate on an edge face of the blade 39. Accordingly, the charge roller 9 disposed at a downstream side of a surface movement direction of the photoconductor 8 may not have lubricant or toner (or accumulated materials) stick thereto, and thereby an abnormal image due to accumulated materials sticking on the charge roller 9 can be reduced or prevented.

Furthermore, in the exemplary embodiments, the process cartridge 23 may integrally include the photoconductor 8, the lubricant application unit 47 and at least one of the development unit 10, the first cleaning unit 11, or the charge roller 9, and the process cartridge 23 may be detachably mountable to the image forming apparatus 1. The lubricant application unit 47 can be used to reduce passing through of lubricant or toner at the blade 39, which may happen at a given interval or sporadically, by which a contamination of the charge roller 9 by lubricant or toner can be reduced, and thereby formation of an abnormal image can be reduced.

Furthermore, the lubricant application unit 47 includes a configuration reducing a blade curling, by which the lubricant application unit 47 can maintain a good performance over time.

Furthermore, a maintenance work or the like can be conducted easily for the lubricant application unit 47 or the like disposed in the process cartridge 23.

Furthermore, in the exemplary embodiments, the image forming apparatus includes the first cleaning unit 11 for cleaning adhered materials adhered on the photoconductor 8, and the lubricant application unit 47 for applying lubricant on the photoconductor 8. The lubricant application unit 47 can be used to reduce passing through of lubricant or toner at the blade 39, which may happen at a given interval or sporadically, by which a contamination of the charge roller 9 by lubricant or toner can be reduced, and thereby formation of an abnormal image can be reduced. Furthermore, the lubricant application unit 47 includes a configuration reducing a blade curling, by which the lubricant application unit 47 may have a good performance over time.

Furthermore, in the exemplary embodiments, the image forming apparatus includes the process cartridge 23, which may integrally include the photoconductor 8, the lubricant application unit 47, and at least one of the development unit 10, the first cleaning unit 11, or the charge roller 9, and the process cartridge 23 may be detachably mountable to the image forming apparatus 1. The lubricant application unit 47 can be used to reduce passing through of lubricant or toner at the blade 39, which may happen at a given interval or sporadically, by which a contamination of the charge roller 9 by lubricant or toner can be reduced, and thereby formation of an abnormal image can be reduced. Furthermore, the lubricant application unit 47 includes a configuration reducing a blade curling, by which the lubricant application unit 47 can maintain a good performance over the time. Furthermore, a maintenance work or the like can be conducted easily for the lubricant application unit 47 or the like disposed in the process cartridge 23.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined with each other and/or substituted for each other within the scope of this disclosure and appended claims.

The invention claimed is:

1. A lubricant application apparatus, comprising:

a lubricant application member configured to apply lubricant to a lubricant receiving member moving in a predetermined surface movement direction;

an elastic member is configured to contact the lubricant receiving member in a counter direction with respect to the surface movement direction of the lubricant receiving member, and configured to smooth the lubricant applied on the lubricant receiving member, the elastic member being shaped as a blade, the elastic member being in contact with the lubricant receiving member at a contact area of the elastic member, in the counter direction, with a contact angle of 85 degrees or more, the contact angle being defined by an edge face of the elastic member and a tangent line at the contact area, the elastic member being positioned at a downstream side of the surface movement direction of the lubricant receiving member with respect to the contact area of the elastic member.

2. The lubricant application apparatus of claim 1, wherein the contact angle is from 90 degrees to 95 degrees.

3. The lubricant application apparatus of claim 2, wherein the contact angle is 90 degrees.

4. The lubricant application apparatus of claim 1, wherein the elastic member contacts the lubricant receiving member with one side face of the elastic member adjacent to the contact area.

5. The lubricant application apparatus of claim 1, wherein the elastic member has a JIS-A hardness of 73 degrees.

6. The lubricant application apparatus of claim 1, wherein the elastic member is disposed under a rotation center of the lubricant receiving member in a gravitation direction.

7. A process cartridge detachably mountable to an image forming apparatus, comprising:

the lubricant application apparatus according to claim 1;

an image carrying member; and at least one of a development unit, a cleaning device, or a charge device, wherein the process cartridge integrally supports the lubricant application apparatus, the image carrying member, and the at least one of the development unit, the cleaning device, or the charge device.

8. The process cartridge of claim 7, wherein the contact angle is from 90 degrees to 95 degrees.

9. The process cartridge of claim 7, wherein the contact angle is 90 degrees.

10. The process cartridge of claim 7, wherein the elastic member contacts the lubricant receiving member with one side face of the elastic member adjacent to the contact area.

11. The process cartridge of claim 7, wherein the elastic member has a JIS-A hardness of 73 degrees.

12. The process cartridge of claim 7, wherein the elastic member is disposed under a rotation center of the lubricant receiving member in a gravitation direction.

13. An image forming apparatus, comprising:

an image carrying member;

a charge device configured to charge the image carrying member;

a cleaning device configured to clean materials adhered on the image carrying member; and the lubricant application apparatus according to claim 1.

14. The image forming apparatus of claim 13, wherein the lubricant application apparatus is integrated with the image carrying member and at least one of a development unit, the cleaning device, or the charge device as a process cartridge detachably mountable to the image forming apparatus.

15. The image forming apparatus of claim 13, wherein the contact angle is from 90 degrees to 95 degrees.

16. The image forming apparatus of claim 13, wherein the contact angle is 90 degrees.

17. The image forming apparatus of claim 13, wherein the elastic member contacts the lubricant receiving member with one side face of the elastic member adjacent to the contact area.

18. The image forming apparatus of claim 13, wherein the elastic member has a JIS-A hardness of 73 degrees.

19. The image forming apparatus of claim 13, wherein the elastic member is disposed under a rotation center of the lubricant receiving member in a gravitation direction.

* * * * *